US006376983B1

(12) United States Patent
Beeteson et al.

(10) Patent No.: US 6,376,983 B1
(45) Date of Patent: Apr. 23, 2002

(54) ETCHED AND FORMED EXTRACTOR GRID

(75) Inventors: John Stuart Beeteson, Skelmorlie (GB); John Ulrich Knickerbocker, Hopewell Junction, NY (US); Andrew Ramsay Knox, Kilbirnie; Anthony Cyril Lowe, Braishfield, both of (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/116,403

(22) Filed: Jul. 16, 1998

(51) Int. Cl.[7] ..... H01J 29/48; H01J 29/64
(52) U.S. Cl. ..... 313/495; 313/497; 313/431
(58) Field of Search ..... 313/495, 497, 313/442, 421, 425, 431

(56) References Cited

U.S. PATENT DOCUMENTS 4,719,388 A 1/1988 Oess ..... 315/169.1
5,603,649 A 2/1997 Zimmerman

FOREIGN PATENT DOCUMENTS

GB 2 304 981 3/1997

*Primary Examiner*—Ashok Patel
(74) *Attorney, Agent, or Firm*—Margaret A. Pepper

(57) ABSTRACT

An electron source comprises at least one cathode means, and at least one extractor grid which is used to extract electrons from the cathode means. The extractor grid is a substantially planar sheet having at least one aperture and also has at least one spacing member for spacing the extractor grid at a constant, predetermined spacing from the cathode. Each of the spacing members are formed by removing material around a substantial portion of the periphery of the aperture and folding the remaining portion of the periphery of the aperture at substantially a right angle to the planar sheet.

22 Claims, 5 Drawing Sheets

ETCHED AND FORMED EXTRACTOR GRID

FIELD OF THE INVENTION

The present invention relates to an extractor grid for an electron source used in a display device and more particularly to an electron source for use in a matrix addressed electron beam display.

BACKGROUND OF THE INVENTION

Electron sources are particularly, although not exclusively, useful in display applications, especially flat panel display applications. Such applications include television receivers and visual display units for computers, especially, although not exclusively, portable computers, personal organizers, communications equipment, and the like.

U.S. patent application Ser. No. 08/695,856, filed on Aug. 9, 1996 now U.S. Pat. No 5,917,277, which corresponds to UK Patent Application No. 2304981, assigned to the assignee of the instant Patent Application and the disclosure of which is incorporated herein by reference, discloses a magnetic matrix display having as an electron source a cathode for emitting electrons, a permanent magnet with a two dimensional array of channels extending between opposite poles of the magnet, the direction of magnetization being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of stripes per column, each stripe corresponding to a different channel. Flat panel display devices based on a magnetic matrix will hereinafter be referred to as MMD or Magnetic Matrix Display.

A remote virtual cathode system used as the cathode in a Magnetic Matrix Display employs a mesh or grid in the vicinity of the physical cathode (the source of electrons) to extract electrons from the local virtual cathode (the space charge cloud in front of the physical cathode) by means of a positive potential on the grid with respect to the physical cathode potential. The virtual cathode potential is slightly below that of the physical cathode potential by virtue of the presence of a substantial number of negatively charged electrons—the space charge cloud—and the virtual cathode is typically a few tens of micrometers in front of the physical cathode.

Child's Law $$j_e = 4\frac{\epsilon_0}{9}\sqrt{2\frac{Z_q}{m_0}\cdot\frac{V_0^{\frac{3}{2}}}{d^2}}$$

j=current density

Z is the charge on the particle

V is the accelerating voltage m is the rest mass of the particle d is the accelerating gap Child's Law is an empirically determined relationship which, amongst other things, relates current density, extraction voltage and distance between the extraction grid and the physical cathode. Note that Child's Law is a one-dimensional model only. Changes in distance between the extractor grid and electron source will result in changes in the current density which can be extracted from the virtual cathode, hence resulting in a luminance non-uniformity in a display employing such a system.

A second issue that must be addressed in a remote virtual cathode is the efficiency of the system. Some electrons will collide with the extractor grid. The percentage that do so may be found, to a first approximation, by the "aperture ratio" of the grid. If, for example, the grid is formed by 10 $\mu$m wide wires on 250 $\mu$m centers, the ratio of "open" area to the total area is $240^2/250^2$=92.16 percent. In other words, 7.84 percent of the extracted electrons will collide with the grid after leaving the virtual cathode and will not contribute to the remote virtual cathode.

The preferred remote virtual cathode system operates by allowing the electrons to continually oscillate through the extractor grid. The extractor grid is at a positive potential with respect to the physical cathode and remote virtual cathode. Each time an individual electron passes through the extractor grid, it has, for the example square mesh grid above, a 7.84 percent chance of colliding with the grid and being "lost".

Therefore, it is most desirable that the extractor grid have the maximum possible transmission to retain high efficiency.

A third effect that may manifest itself in a remote virtual cathode system is interaction between the X-Y aperture structure of the pixels in the display and the X-Y structure of the extractor grid. If the two are closely (but not perfectly) aligned, an effect akin to Moire fringing may occur. This will lead to luminance uniformity problems over the display area.

For successful implementation of a remote virtual cathode system the following problems must be solved:

1. Maintaining a constant distance between the electron source and the extractor grid. This, coupled with a constant extraction voltage will ensure extraction current density consistent with the emission properties of the cathode. (It will not compensate for emission non-uniformities on the physical cathode surface which may be attenuated by equalization of the local virtual cathode potential due to space charge effects therein.)

2. Providing the extractor grid with sufficient aperture ratio to achieve the desired efficiency.

3. Ensuring that there are no interference effects between the pixel array structure and the extractor grid.

PURPOSES AND SUMMARY OF THE INVENTION

Therefore, one purpose of this invention is to have an extractor grid for an electron source used in a display device, and more particularly to an electron source for use in a matrix addressed electron beam display.

Another purpose of this invention is to have the electron source further comprising a permanent magnet perforated by a plurality of channels extending between opposite poles of the magnet wherein each channel forms electrons received from the cathode means into an electron beam for guidance towards a target.

Still another purpose of this invention is to have at least one aperture in the extractor grid correspond to at least one of the plurality of channels in the permanent magnet.

Yet another purpose of this invention is to have each one of the plurality of apertures in the extractor grid correspond to a plurality of the plurality of channels in the permanent magnet.

Still yet another purpose of the invention is to have the extractor grid further comprise a frame positioned at the periphery of the extractor grid and the extractor grid is located on the frame by means of a plurality of insulating members.

Yet another purpose of the invention is that the spacing member further comprise at least one dielectric layer or metal oxide layer which substantially covers the spacing member.

Therefore, in one aspect this invention comprises an electron source comprising at least one cathode means, and at least one extractor grid used to extract electrons from said cathode means, said extractor grid being a substantially planar sheet having at least one aperture in said sheet and having at least one spacing member for spacing said extractor grid at a constant, predetermined spacing from said cathode, said spacing member being formed by removing material around a substantial portion of said periphery of said aperture and folding a remaining portion of said periphery of said aperture at substantially a right angle to said planar sheet.

In another aspect this invention comprises a display device comprising:

an electron source comprising:

cathode means, and an extractor grid used to extract electrons from said cathode means, said extractor grid being a substantially planar sheet having a plurality of apertures in said sheet and having a plurality of spacing members for spacing said extractor grid at a constant, predetermined spacing from said cathode means, each of said spacing members being formed by removing material around a substantial portion of said periphery of said apertures form at least one flap, and folding at least a portion of said periphery of said flap at substantially a right angle to said planar sheet, a permanent magnet perforated by a plurality of channels extending between opposite poles of said magnet wherein each channel forms electrons received from said cathode means into an electron beam for guidance towards a target;

a screen for receiving electrons from said electron source, said screen having a phosphor coating facing said side of said magnet remote from said electron source;

grid electrode means disposed between said electron source and said magnet for controlling flow of electrons from said electron source into each channel;

anode means disposed on said surface of said magnet remote from said electron source for accelerating electrons through said channels; and means for supplying control signals to said grid electrode means and said anode means to selectively control flow of electrons from said electron source to said phosphor coating via said channels thereby to produce an image on said screen.

In yet another aspect this invention comprises a computer system comprising: memory means; data transfer means for transferring data to and from said memory means; processor means for processing data stored in said memory means; and a display device for displaying data processed by said processor means, said display device comprising:

an electron source comprising:

at least one cathode means, and at least one extractor grid used to extract electrons from said cathode means, said extractor grid being a substantially planar sheet having at least one aperture in said sheet and having at least one spacing member for spacing said extractor grid at a constant, predetermined spacing from said cathode means, each of said spacing member being formed by removing material around a substantial portion of said periphery of said aperture and folding a remaining portion of said periphery of said aperture at substantially a right angle to said planar material, a permanent magnet perforated by at least one channel extending between opposite poles of said magnet wherein each channel forms electrons received from said cathode means into an electron beam for guidance towards a target;

a screen for receiving electrons from said electron source, said screen having a phosphor coating facing said side of said magnet remote from said electron source;

grid electrode means disposed between said electron source and said magnet for controlling flow of electrons from said electron source into each channel;

anode means disposed on said surface of said magnet remote from said electron source for accelerating electrons through said channel; and means for supplying control signals to said grid electrode means and said anode means to selectively control flow of electrons from said electron source to said phosphor coating via said channels thereby to produce an image on said screen.

BRIEF DESCRIPTION OF THE DRAWINGS

The features of the invention believed to be novel and the elements characteristic of the invention are set forth with particularity in the appended claims. The drawings are for illustration purposes only and are not drawn to scale. Furthermore, like numbers represent like features in the drawings. The invention itself, however, both as to organization and method of operation, may best be understood by reference to the detailed description which follows taken in conjunction with the accompanying drawings in which:

DETAILED DESCRIPTION OF THE INVENTION

The present invention uses the same manufacturing process that forms the magnet structure in the MMD for the fabrication of the extractor grid. This involves an etching process to remove unwanted areas of a metal sheet. Examples of preferred metal sheet, include stainless steel sheet, nickel metal sheet, to name a few.

Figure 1:
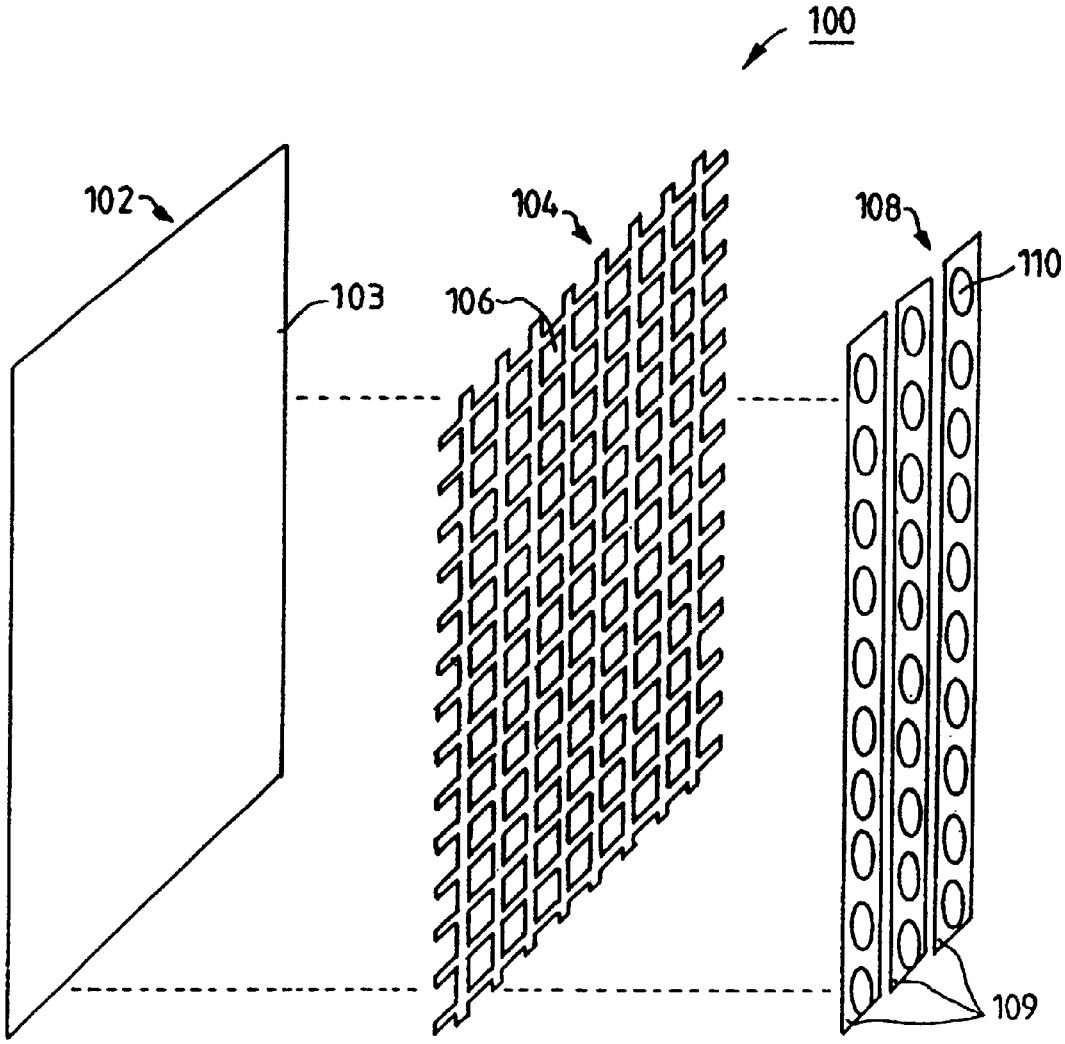
FIG. 1, is a schematic diagram of a cathode and an extractor grid used in a magnetic matrix display.

FIG. 1, shows electron source 100, according to the present invention. An electron source substrate or cathode 102, has a cathode material 103, deposited on a surface facing an extractor grid 104, having openings or apertures 106. Also shown in FIG. 1, are a first set of control grids 108, in the form of stripes 109, having an opening or aperture 110, corresponding to each pixel of a display. In operation of the display, the cathode 102, is held at a reference potential, the extractor grid 104, is at a positive potential with respect to the cathode 102, and the control grid 108, is held at a negative potential with respect to the cathode 102. Because the extractor grid 104, is at a positive potential with respect to the cathode 102, then regardless of the initial direction of the emitted electrons, they are rapidly accelerated towards the extractor grid 104. Given that the initial energy of the electron is low (a few eV at most), and that the extractor grid 104, is at a potential of a few tens of volts, to a first approximation, the electrons may be considered to meet the extractor grid 104, with a normal angle of incidence. Thus the extractor grid's 104, transmission is approximately the ratio of the "open" area to the total area. This figure is typically greater than 90 percent, and so more than 90 percent of electrons pass through the extractor grid 104.

A benefit of the use of an extractor grid 104, is that the distance between the physical cathode and the remote virtual cathode from where electrons appear to be emitted is many times greater with an extractor grid 104, than for a normal cathode without an extractor grid 104. With the use of an extractor grid 104, the separation may be several mm. Without an extractor grid 104, the separation is typically less than 50 $\mu$m. This increased separation means that the electron's lateral component of motion across the cathode surface now has a bearing on overall cathode uniformity since any cathode "structure" leading to non-uniformities of emission tends to be blurred. The magnetic field from the magnet in a magnetic matrix display also further modifies electron trajectories, especially at the remote virtual cathode where the magnetic field is strongest and the electrons have the lowest velocity normal to the plane of the remote virtual cathode surface.

Figure 2:
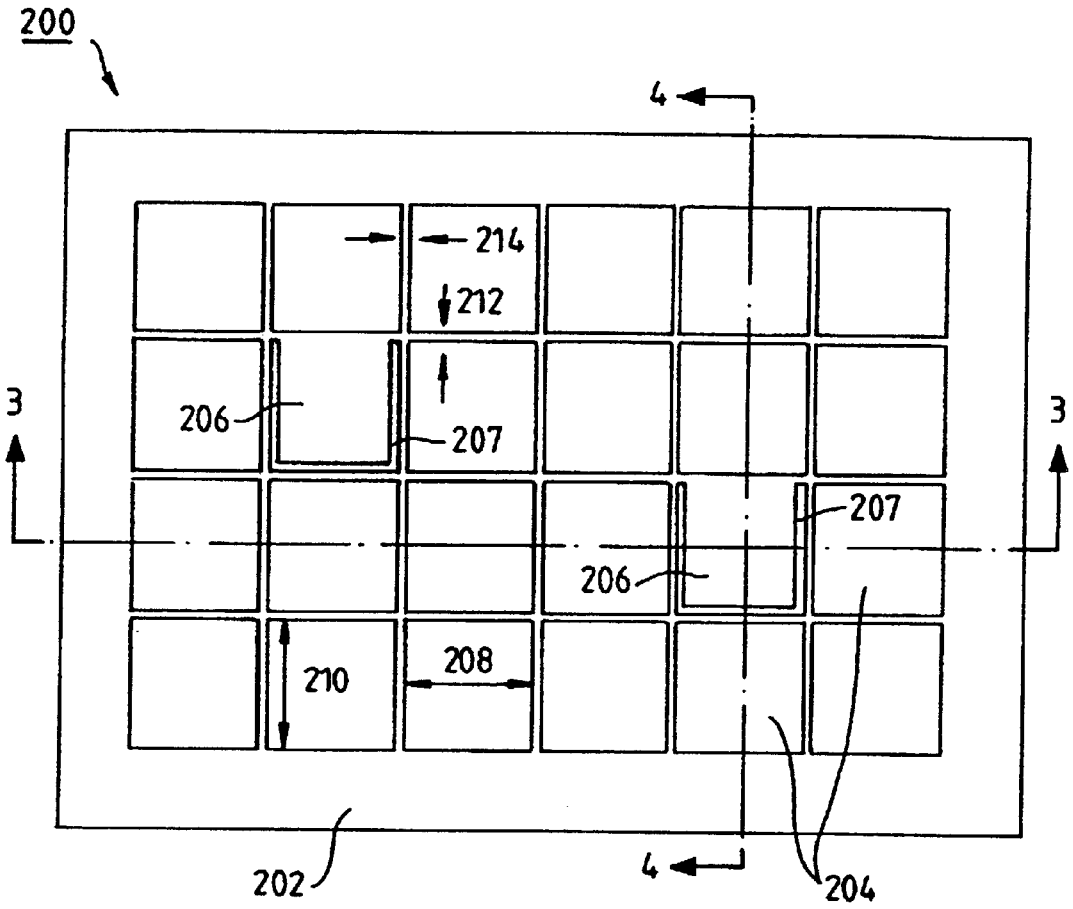
FIG. 2, shows an example pattern for an extractor grid according to an embodiment of the present invention.

FIG. 2, shows an example pattern for an embodiment of an extractor grid 200, according to the present invention. The extractor grid 200, may be made of a material such as stainless steel and would preferably be about 50 $\mu$m in thickness. Around the periphery of the extractor grid 200, is a frame 202, for mechanical location and support of the extractor grid 200. The extractor grid 200, has a plurality of openings 204 and 207. The openings 204, are typically etched regions and have a square shape. A small number of the openings 207, have a 'U' shaped type opening, rather than the full square shaped type opening of etched features 204. The unremoved portion from the extractor grid 200, creates a flap type region 206. The manufacturing process is typically an existing well-known prior art one involving steps of cleaning, coating with resist, photo-exposing, etching and cleaning.

Figure 3:
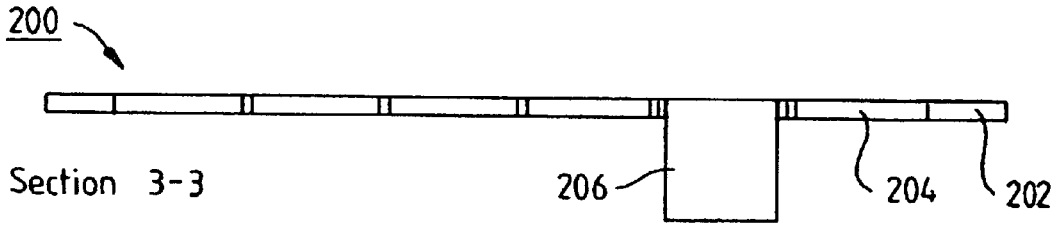
FIG. 3, shows a section 3—3 through the extractor grid of FIG. 2.
Figure 4:
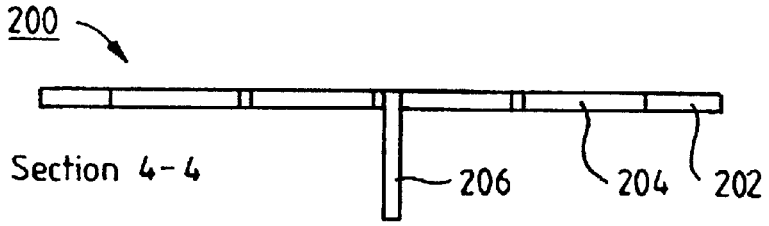
FIG. 4, shows a section 4—4 through the extractor grid of FIG. 2.

FIG. 3, shows a section 3—3 through the extractor grid 200, of FIG. 2, where, after etching, the flaps 206, are formed and are bent through 90 degrees by a mechanical forming operation, converting the extractor grid 200, from an essentially two dimensional structure to a three dimensional structure. The flaps 206, can be used to precisely space the extractor grid 200, from the cathode substrate 102. FIG. 4, shows a section 4—4 through the extractor grid 200, of FIG. 2. FIG. 2, shows a square flap 206, contained by the 'U' shape etching but any desired profile may be used in place of a square profile.

In FIG. 2, the dimensions 208 and 210, of the apertures 204, in the extractor grid 200, are typically about 240 $\mu$m, and the dimensions of the spacings between the apertures is typically about 10 $\mu$m. These dimensions result in an aperture grid with an about 250 $\mu$m pitch and limit the maximum available spacing formed by the folded flaps 206, to the aperture width (240 $\mu$m) minus the etch width (10 $\mu$m), which gives 230 $\mu$m. The flap 206, itself is typically about 240 $\mu$m by 230 $\mu$m in size.

Figure 5:
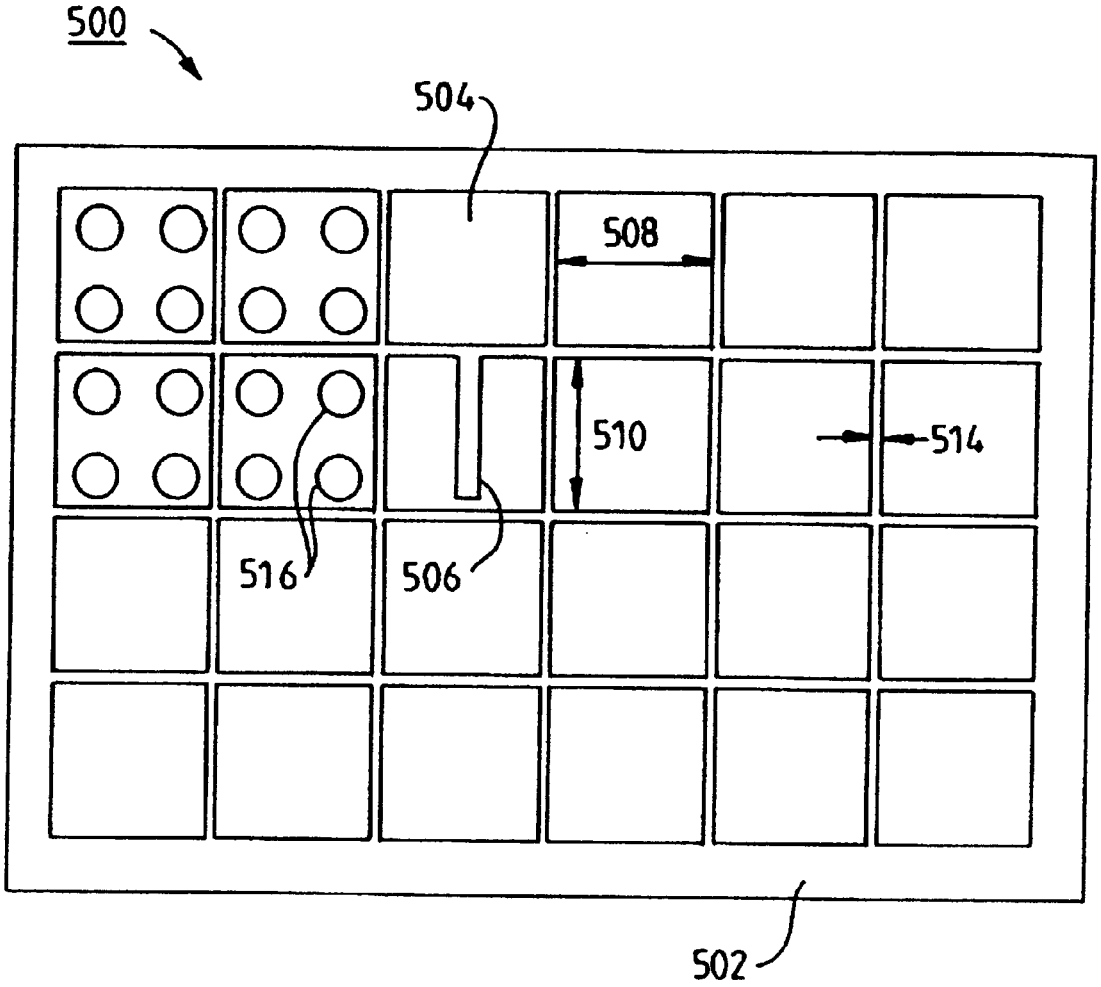
FIG. 5, is an example pattern for an extractor grid according to another embodiment of the present invention.

In an another embodiment of the present invention, a spacing greater than that of a single aperture dimension may be achieved, as shown in FIG. 5. FIG. 5, shows one extractor grid aperture 504, for every four pixels 516, (shown as circles 516, in the figure) on a display screen 500. In FIG. 5, the dimensions 508 and 510, of the apertures 504, in the extractor grid 500, are typically about 490 $\mu$m, and the dimensions of the spacings between the apertures is typically about 10 $\mu$m. These dimensions result in an aperture grid with typically about a 500 $\mu$m pitch and limit the maximum available spacing formed by the folded flaps to the aperture width of about 490 $\mu$m. The flap or spacer (not shown) in this figure is longer (about 480 $\mu$m) and of a narrower profile than that of FIG. 2. The increased length is due to the larger aperture size used. A narrower profile 506, is shown for the purposes of illustration, however any different profile can also be used. A profile such as that of FIG. 2, where the spacer or flap has a width equal to the aperture size may also be used in this embodiment, as may other geometries, different spacer sizes and distances. Although one extractor grid aperture 504, for every four pixels 516, has been described, other numbers of pixels may be used, including arrangements which are rectangular, rather than square, or any other odd shape.

Since the extractor grid is etched, it may have an extremely tight tolerance. This solves the problem of maintaining a constant distance between the electron source and the extractor grid. The small dimensions to which it is possible to produce the wires of the extractor grid to help to ensure that the extractor grid has sufficient aperture ratio to achieve the desired efficiency. Most importantly, the extractor grid of the present invention can be used to ensure that there are no interference problems caused by the spacing of the apertures in the extractor grid and the spacing of the apertures in the magnet by precisely aligning the magnet and pixel apertures, so avoiding potential interference problems between the spacing of the apertures in the extractor grid and the spacing of the apertures in the magnet used in the magnetic matrix display.

Figure 6:
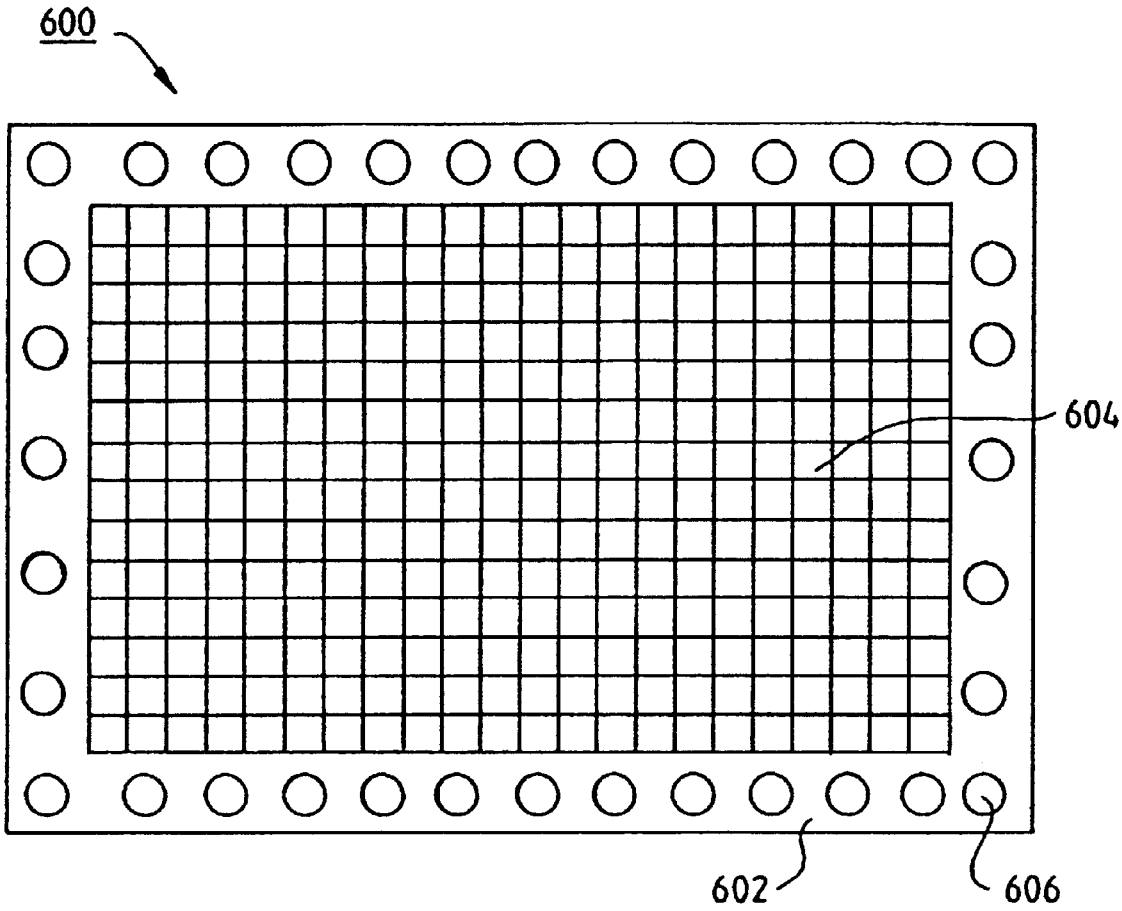
FIG. 6, shows the extractor grid of FIG. 2, or FIG. 5, mounted on a frame.

FIG. 6, shows a representation of the complete extractor grid 600, for the display mounted on a frame 602. During fabrication of this grid/frame assembly, a grid 604, is first heated to cause expansion of the metal forming the grid 604. While the grid 604, is hot, it is mounted on a frame 602, so that when it cools, thermal contraction of the grid 604, causes the grid 604, to be pulled into tension across its area.

Figure 7:
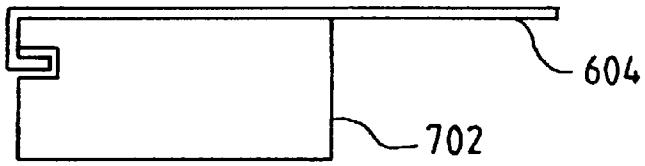
FIG. 7, shows the extractor grid of FIG. 2, or FIG. 5, with at least one ceramic insulating support.

If the frame 602, is to be electrically isolated from the grid 604, the grid 604, may be secured by the use of a variety of existing methods, providing they are vacuum-compatible. For example, ceramic studs may be used at regular or irregular intervals about the periphery of the grid to provide the required electrical isolation, as shown by the locating points 606, in FIG. 6, which could be used to accommodate ceramic stud or electrical isolation stud. FIG. 7, shows a variation of the preferred embodiment, in which ceramic spacer or strips 702, are mounted onto the frame 602, over which the grid 604, is placed whilst hot, as shown in section in FIG. 7.

Figure 8:
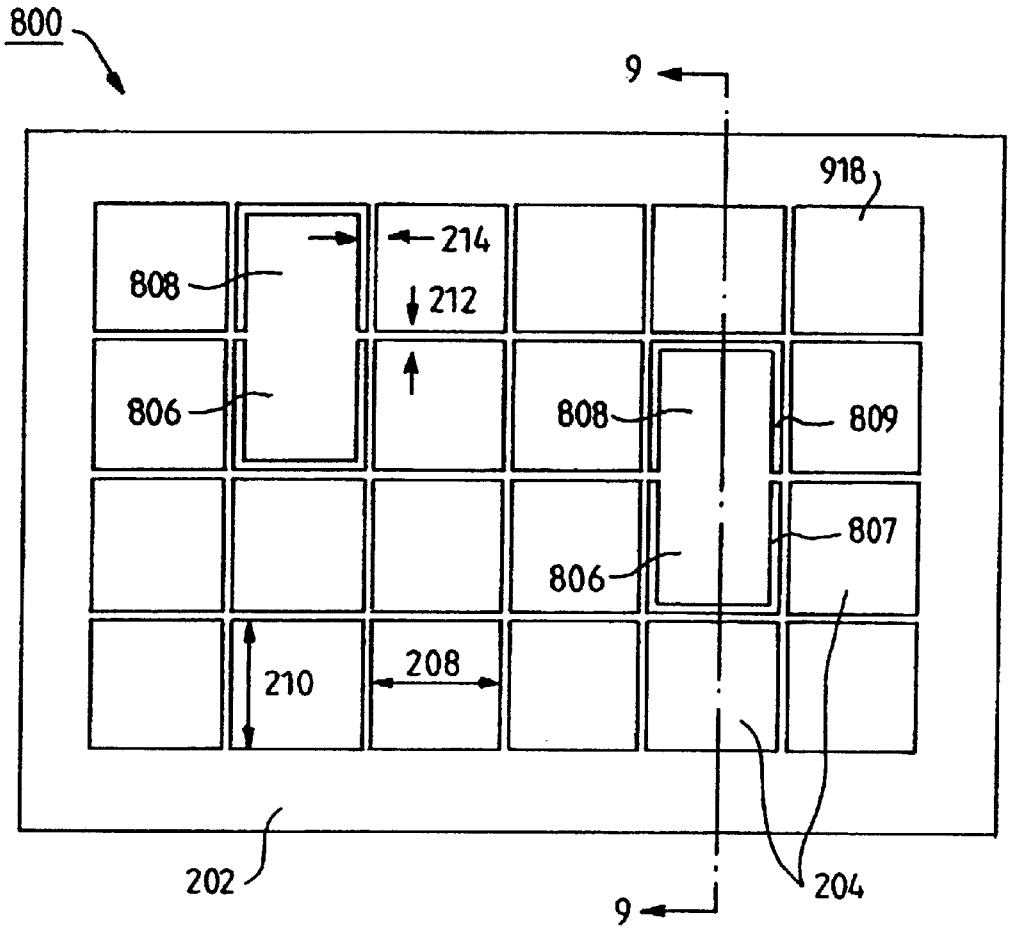
FIG. 8, is an example pattern for an extractor grid according to yet another embodiment of the present invention.
Figure 9:
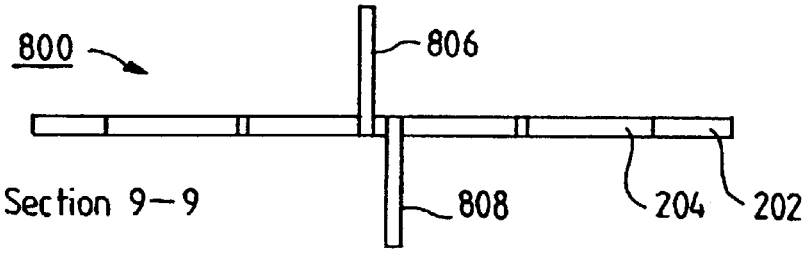
FIG. 9, shows a section 9—9 through the extractor grid of FIG. 8.

FIG. 8, shows a variation of the embodiment of the invention shown in FIGS. 2 to 4, in which the mechanical forming operation bends the spacers or flaps 806, 807, in opposite directions, so forming a structure that may be used to hold apart two other plates, one on each side of an extractor grid 800. FIG. 9, shows a section 9-9 through the extractor grid of FIG. 8. An example where this variation of the illustrated embodiment may be used is in the separation of the magnet and back plate of a Magnetic Matrix Display.

In a remote virtual cathode system as described above, there are at least three distinct potentials—the physical cathode, the extractor grid and the plane used to turn the electrons after they pass through the grid, i.e., to form the remote virtual cathode. Typically in a Magnetic Matrix Display this will be the G1 conductors. These different voltages should not be shorted together by the extractor grid. To ensure this, and avoid the use of discrete insulators, the bent lugs may be coated in a ceramic or glass material which is then fired. Although the area over which the grid will actually be supported is small, and the thickness of the glass or ceramic layer low, its mode of use is ideal for the material—highest mechanical strength under compression and good electrical breakdown properties.

Alternatively, the bent lugs may provide electrical insulation through surface oxidation. The extractor grid may be of a material, such as, nickel, and an insulating dielectric may be achieved through high temperature surface oxidation of the bent lugs.

The invention has been described with reference to a magnetic matrix display, however, an extractor grid according to the present invention may be used in any flat panel display which utilizes an electron source.

In an optional variation of the present invention, depicts at least one dielectric layer 918, over the metallic flaps which assists in reducing the disturbance of an electrostatic field caused by the presence of the conductor. Although depicted in FIG. 9, such a dielectric layer is not essential to the embodiment of FIG. 9, which may be used without such a layer. Additionally, at least one dielectric layer 918, may be also used with any of the embodiments disclosed here.

It should be appreciated that the shape of at least one aperture in the extractor grid could be selected from a group comprising a rectangular shape, a circular shape, a polygonal shape, a triangular shape, or "U" shape or any irregular shape, to name a few.

The invention further provides a computer system comprising: memory means; data transfer means for transferring data to and from the memory means; processor means for processing data stored in the memory means; and a display device as described above for displaying data processed by the processor means.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An electron source comprising at least one cathode means, and at least one extractor grid used to extract electrons from said cathode means, said extractor grid being a substantially planar sheet having at least one aperture in said sheet and having at least one spacing member for spacing said extractor grid at a constant, predetermined spacing from said cathode means, said spacing member being formed by removing material around a substantial portion of a periphery of said aperture and folding a remaining portion of said periphery of said aperture at substantially a right angle to said planar sheet.

2. The electron source of claim 1, further comprising a permanent magnet having at least one opening to guide electrons received from said cathode means into an electron beam for guidance towards at least one target.

3. The electron source of claim 2, wherein said permanent magnet has at least one channel that extends between opposite poles of said magnet, and wherein each channel forms at least one opening to guide electrons received from said cathode means into an electron beam towards at least one target.

4. The electron source of claim 2, further comprising grid electrode means disposed between said cathode means and said magnet for controlling flow of said electrons from said cathode means.

5. The electron source of claim 2, wherein each aperture in said extractor grid corresponds to said opening in said permanent magnet.

6. The electron source of claim 3, wherein each aperture in said extractor grid corresponds to a plurality of channels in said permanent magnet.

7. The electron source of claim 2, wherein material for said extractor grid is at least one metal.

8. The electron source of claim 2, wherein material for said extractor grid is at least one metal, and wherein said at least one metal is selected from a group consisting of nickel, stainless steel or alloy thereof.

9. The electron source of claim 1, wherein thickness of said extractor grid is between about 40 $\mu$m and about 70 $\mu$m.

10. The electron source of claim 1, wherein pitch between adjacent apertures is between about 200 $\mu$m and about 1 mm.

11. The electron source of claim 1, wherein pitch between adjacent apertures is between about 200 $\mu$m and about 300 $\mu$m.

12. The electron source of claim 3, wherein at least one of said aperture in said extractor grid corresponds to at least one channel in said permanent magnet.

13. The electron source of claim 3, wherein each of said aperture in said extractor grid corresponds to at least one channel in said permanent magnet.

14. The electron source of claim 3, wherein each of said aperture in said extractor grid corresponds to at least two channel in said permanent magnet and the pitch between adjacent apertures is between about 400 $\mu$m and about 600 $\mu$m.

15. An electron source comprising at least one cathode means, at least one extractor grid used to extract electrons from said cathode means, said extractor grid being a substantially planar sheet having at least one aperture in said sheet and having at least one spacing member for spacing said extractor grid at a constant, predetermined spacing from said cathode means, said spacing member being formed by removing material around a substantial portion of a periphery of said aperture and folding a remaining portion of said periphery of said aperture at substantially a right angle to said planar sheet, and a permanent magnet having at least one opening to guide electrons received from said cathode means into an electron beam for guidance towards at least one target, wherein said extractor grid further comprises a frame positioned at said periphery of said extractor grid and said extractor grid is located on said frame by means of at least one electrically insulating member.

16. The electron source of claim 15, wherein said electrically insulating member is selected from a group consisting of at least one ceramic material, glass material or metal oxide material.

17. The electron source of claim 15, wherein said electrically insulating member comprises of at least one strip located on the periphery of said frame.

18. The electron source of claim 15, wherein said electrically insulating member comprises of at least one strip located on the periphery of said frame, and wherein said electrically insulating strip is selected from a group consisting of at least one ceramic material, glass material or metal oxide material.

19. The electron source of claim 1, wherein at least a portion of said extractor grid has at least one coating of at least one dielectric material.

20. The electron source of claim 1, wherein the shape of at least one of said aperture is selected from a group consisting of a rectangular shape, a circular shape, a polygonal shape, a triangular shape, "U" shape, or any irregular shape.

21. A display device comprising:

an electron source comprising:

cathode means, and an extractor grid used to extract electrons from said cathode means, said extractor grid being a substantially planar sheet having at least one aperture in said sheet and having at least one spacing member for spacing said extractor grid at a constant, predetermined spacing from said cathode means, each said spacing member being formed by removing material around a substantial portion of a periphery of said aperture and folding a remaining portion of said periphery of said aperture at substantially a right angle to said planar sheet, a permanent magnet perforated by at least one channel extending between opposite poles of said magnet wherein each channel forms electrons received from said cathode means into an electron beam for guidance towards a target;

a screen for receiving electrons from said electron source, said screen having a phosphor coating facing said side of said magnet remote from said electron source;

grid electrode means disposed between said electron source and said magnet for controlling flow of electrons from said electron source into each channel;

anode means disposed on said surface of said magnet remote from said electron source for accelerating electrons through said channel; and means for supplying control signals to said grid electrode means and said anode means to selectively control flow of electrons from said electron source to said phosphor coating via said channel thereby to produce an image on said screen.

22. A computer system comprising: memory means; data transfer means for transferring data to and from said memory means; processor means for processing data stored in said memory means; and a display device for displaying data processed by said processor means, said display device comprising:

an electron source comprising:

at least one cathode means, and at least one extractor grid used to extract electrons from said cathode means, said extractor grid being a substantially planar sheet having at least one aperture in said sheet and having at least one spacing member for spacing said extractor grid at a constant, predetermined spacing from said cathode means, each said spacing member being formed by removing material around a substantial portion of a periphery of said aperture and folding a remaining portion of said periphery of said aperture at substantially a right angle to said planar sheet, a permanent magnet perforated by at least one channel extending between opposite poles of said magnet wherein each channel forms electrons received from said cathode means into an electron beam for guidance towards a target;

a screen for receiving electrons from said electron source, said screen having a phosphor coating facing said side of said magnet remote from said electron source;

grid electrode means disposed between said electron source and said magnet for controlling flow of electrons from said electron source into each channel;

anode means disposed on said surface of said magnet remote from said electron source for accelerating electrons through said channel; and means for supplying control signals to said grid electrode means and said anode means to selectively control flow of electrons from said electron source to said phosphor coating via said channel thereby to produce an image on said screen.

* * * * *